United States Patent [19]

Wu

[11] Patent Number: 4,827,064

[45] Date of Patent: May 2, 1989

[54] HIGH VISCOSITY INDEX SYNTHETIC LUBRICANT COMPOSITIONS

[75] Inventor: Margaret M. Wu, Belle Mead, N.J.

[73] Assignee: Mobil Oil Corporation, New York, N.Y.

[21] Appl. No.: 210,435

[22] Filed: Jun. 23, 1988

Related U.S. Application Data

[63] Continuation-in-part of Ser. No. 147,064, Jan. 22, 1988, abandoned, which is a continuation of Ser. No. 946,226, Dec. 24, 1986, abandoned.

[51] Int. Cl.[4] ..... C07C 2/08; C07C 9/22

[52] U.S. Cl. ..... 585/10; 585/12; 585/18

[58] Field of Search ..... 585/530, 520, 10, 12, 585/18; 502/319, 305

[56] References Cited

U.S. PATENT DOCUMENTS

| | | | |
|---|---|---|---|
| 2,692,257 | 10/1954 | Zletz | 585/530 |
| 2,826,620 | 3/1958 | Matuszak | 585/530 |
| 3,127,370 | 3/1964 | Head | 585/530 |
| 3,182,048 | 5/1965 | Mills | 502/320 |
| 3,405,191 | 10/1968 | Banks | 585/530 |
| 3,637,503 | 1/1972 | Gianetti | 585/10 |
| 3,655,800 | 4/1972 | Mitchell et al. | 585/530 |
| 3,795,616 | 3/1974 | Heilman et al. | 585/10 |
| 3,965,018 | 6/1976 | Heilman et al. | 585/10 |
| 4,018,695 | 4/1977 | Heilman et al. | 585/10 |
| 4,096,093 | 6/1978 | Hwang | 502/320 |
| 4,247,421 | 1/1981 | McDaniel et al. | 502/171 |
| 4,282,392 | 8/1981 | Cupples et al. | 585/10 |
| 4,434,308 | 2/1984 | Larkin et al. | 585/10 |
| 4,434,309 | 2/1984 | Larkin et al. | 585/10 |
| 4,510,342 | 4/1985 | Currie et al. | 585/10 |
| 4,587,368 | 5/1986 | Pratt | 585/12 |
| 4,613,712 | 9/1986 | Bridger | 585/10 |
| 4,653,437 | 10/1977 | Liu et al. | 502/320 |
| 4,681,866 | 7/1987 | McDaniel et al. | 502/117 |

FOREIGN PATENT DOCUMENTS

| | | | |
|---|---|---|---|
| 575702 | 5/1959 | Canada | 585/530 |
| 3427319 | 1/1986 | Fed. Rep. of Germany . | |
| 814930 | 9/1955 | United Kingdom | 585/530 |
| 1123474 | 8/1968 | United Kingdom | 585/512 |

OTHER PUBLICATIONS

Weiss et al, "Surface Compounds of Transition Metals", J. Catalysis, 88, 424–430 (1984).

*Primary Examiner*—Asok Pal
*Attorney, Agent, or Firm*—Alexander J. McKillop; Charles J. Speciale; L. G. Wise

[57] ABSTRACT

Novel lubricant compositions comprising polyalphaolefins are disclosed having high viscosity indices with low pour point. The compositions are characterized by a uniform molecular structure with low branch ratios. The invention describes a liquid lubricant composition comprising $C_{30}$–$C_{1300}$ hydrocarbons, said composition having a branch ratio of less than 0.19, weight average molecular weight between 300 and 45,000 number average molecular weight between 300 and 18,000, molecular weight distribution between 1 an 5 and pour point below −15° C. 1-decene trimer comprising 9-methyl, 11-octylheneicosane and 11-octyldocosane is disclosed.

27 Claims, 6 Drawing Sheets

FIG. 4
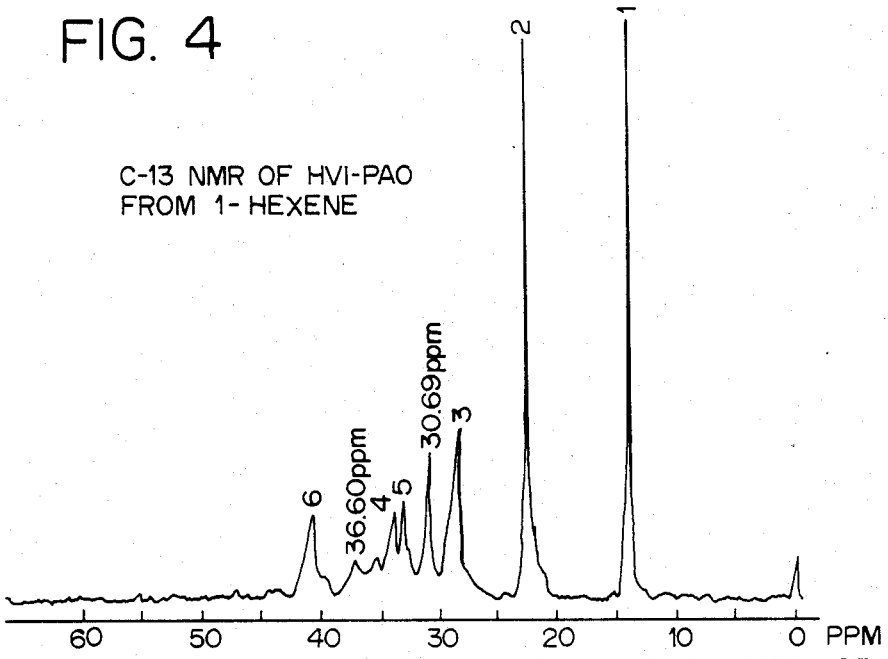
C13-NMR SPECTRA OF 1-HEXENE OLIGOMERS BY $Cr/SiO_2$ CATALYST
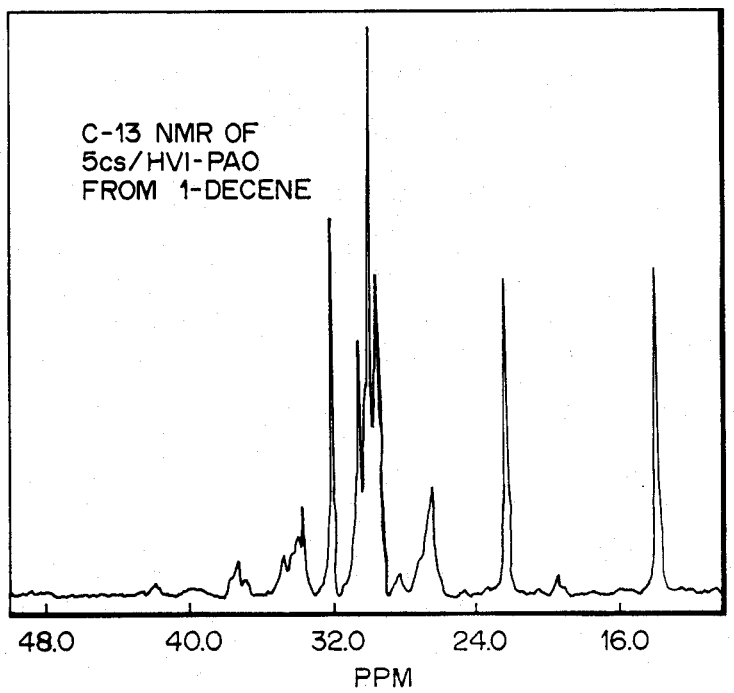
FIG. 5

FIG. 6
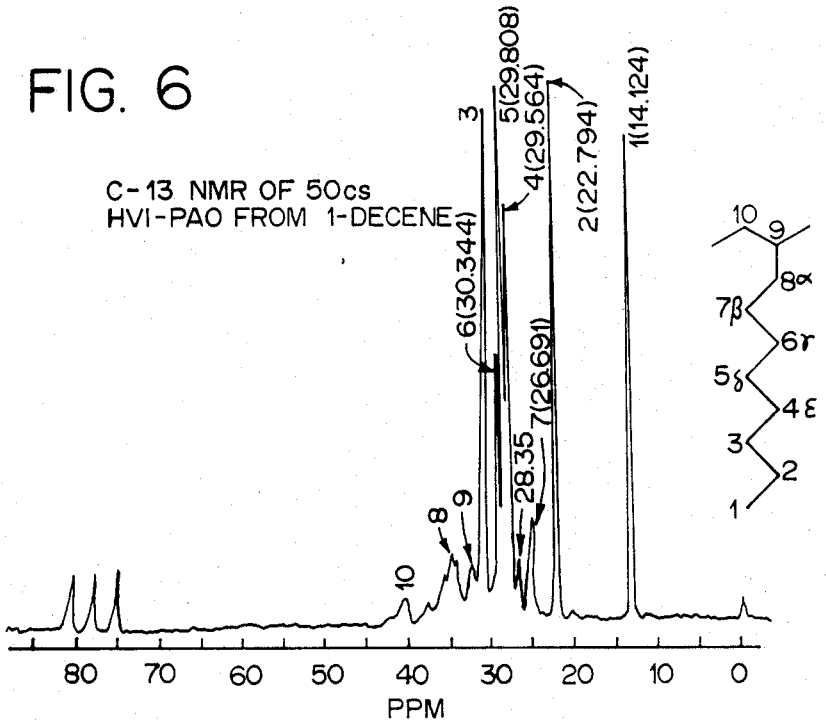
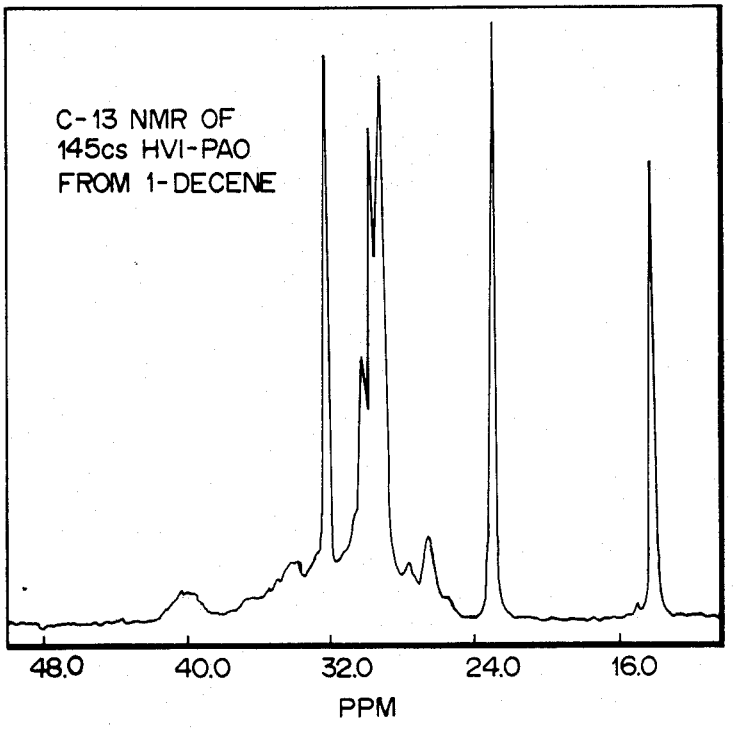
FIG. 7

C-13 NMR OF HVI-PAO 1-DECENE TRIMER
OBSERVED VS CALCULATED SHIFTS

9-METHYL, 11-OCTYLHENEICOSANE

| CARBON POSITION | OBSERVED CHEMICAL SHIFT, PPM | CALCULATED CHEMICAL SHIFT, PPM |
|---|---|---|
| α' | 34.63 | 34.72 |
| β' | 26.99 | 27.27 |
| γ' | 30.40 | 30.21 |
| α'' | 37.81 | 37.16 |
| β'' | 26.99 | 27.27 |
| γ'' | 30.40 | 30.21 |
| T1 | 35.13 | 34.98 |
| T2 | 30.40 | 30.45 |
| M | 42.63 | 41.42 |
| M' | 20.26 | 20.12 |

11-OCTYLDOCOSANE

| CARBON POSITION | OBSERVED CHEMICAL SHIFT, PPM | CALCULATED CHEMICAL SHIFT, PPM |
|---|---|---|
| α' | 34.05 | 34.47 |
| β' | 27.23 | 27.52 |
| γ' | 29.62 | 30.21 |
| δ | 29.96 | 29.96 |
| T3 | 37.81 | 37.05 |

HIGH VISCOSITY INDEX SYNTHETIC LUBRICANT COMPOSITIONS

This application is a continuation-in-part of U.S. patent application Ser. No. 147,064 filed Jan. 22, 1988 which is a continuation of application Ser. No. 946,226 filed Dec. 24, 1986, both now abandoned.

This invention relates to novel lubricant compositions. The invention, more particularly, relates to novel synthetic lubricant compositions prepared from alpha-olefins, or 1-alkenes. The invention specifically relates to novel synthetic lubricant compositions from 1-alkenes exhibiting superior viscosity indices and other improved characteristics essential to useful lubricating oils.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil. These new synthetic lubricants lower friction and hence increase mechanical efficiency across the full spectrum of mechanical loads from worm gears to traction drives and do so over a wider range of operating conditions than mineral oil lubricants.

The chemical focus of the research effort in synthetic lubricants has been on the polymerization of 1-alkenes. Well known structure/property relationships for high polymers as contained in the various disciplines of polymer chemistry have pointed the way to 1-alkenes as a fruitful field of investigation for the synthesis of oligomers with the structure thought to be needed to confer improved lubricant properties thereon. Due largely to studies on the polymerization of propene and vinyl monomers, the mechanism of the polymerization of 1-alkene and the effect of that mechanism on polymer structure is reasonably well understood, providing a strong resource for targeting on potentially useful oligomerization methods and oligomer structures. Building on that resource, in the prior art oligomers of 1-alkenes from $C_6$ to $C_{20}$ have been prepared with commercially useful synthetic lubricants from 1-decene oligomerization yielding a distinctly superior lubricant product via either cationic or Ziegler catalyzed polymerization.

Theoretically, the oligomerization of 1-decene, for example, to lubricant oligomers in the $C_{30}$ and $C_{40}$ range can result in a very large number of structural isomers. Henze and Blair, J.A.C.S. 54,1538, calculate over $60\times10^{12}$ isomers for $C_{30}$–$C_{40}$. Discovering exactly those isomers, and the associated oligomerization process, that produce a preferred and superior synthetic lubricant meeting the specification requirements of wide-temperature fluidity while maintaining low pour point represents a prodigious challenge to the workers in the field. Brennan, Ind. Eng. Chem. Prod. Res. Dev. 1980, 19, 2–6, cites 1-decene trimer as an example of a structure compatible with structures associated with superior low temperature fluidity wherein the concentration of atoms is very close to the center of a chain of carbon atoms. Also described therein is the apparent dependency of properties of the oligomer on the oligomerization process, i.e., cationic polymerization or Ziegler-type catalyst, known and practiced in the art.

One characteristic of the molecular structure of 1-alkene oligomers that has been found to correlate very well with improved lubricant properties in commercial synthetic lubricants is the ratio of methyl to methylene groups in the oligomer. The ratio is called the branch ratio and is calculated from infra red data as discussed in "Standard Hydrocarbons of High Molecular Weight", *Analytical Chemistry, Vol.*25, no.10, p.1466 (1953). Viscosity index has been found to increase with lower branch ratio. Heretofore, oligomeric liquid lubricants exhibiting very low branch ratios have not been synthesized from 1-alkenes. For instance, oligomers prepared from 1-decene by either cationic polymerization or Ziegler catalyst polymerization have branch ratios of greater than 0.20. Shubkin, *Ind. Eng. Chem. Prod. Res. Dev.* 1980, 19, 15–19, provides an explanation for the apparently limiting value for branch ratio based on a cationic polymerization reaction mechanism involving rearrangement to produce branching. Other explanations suggest isomerization of the olefinic group in the one position to produce an internal olefin as the cause for branching. Whether by rearrangement, isomerization or a yet to be elucidated mechanism it is clear that in the art of 1-alkene oligomerization to produce synthetic lubricants as practiced to-date excessive branching occurs and constrains the limits of achievable lubricant properties, particularly with respect to viscosity index. Obviously, increased branching increases the number of isomers in the oligomer mixture, orienting the composition away from the structure which would be preferred from a consideration of the theoretical concepts discussed above.

U.S. Pat. No. 4,282,392 to Cupples et al. discloses an alpha-olefin oligomer synthetic lubricant having an improved viscosity-volatility relationship and containing a high proportion of tetramer and pentamer via a hydrogenation process that effects skeletal rearrangement and isomeric composition. The composition claimed is a trimer to tetramer ratio no higher than one to one. The branch ratio is not disclosed.

A process using coordination catalysts to prepare high polymers from 1-alkenes, especially chromium catalyst on a silica support, is described by Weiss et al. in Jour. Catalysis 88, 424–430 (1984) and in Offen. DE 3,427,319. The process and products therefrom are discussed in more detail hereinafter in comparison with the process and products of the instant invention.

It is an object of the present invention to provide a novel synthetic liquid lubricant composition having superior lubricant properties based on oligomerized alpha-olefins.

It is another object of the instant invention to provide a novel synthetic liquid lubricant having a low branch ratio, high viscosity index and low pour point.

Yet another object of the invention is to provide a hydrogenated polyalpha-olefin synthetic liquid lubricant having a high viscosity index and low pour point.

SUMMARY OF THE INVENTION

Liquid hydrocarbon lubricant compositions have been discovered from $C_6$–$C_{20}$ 1-alkene oligomerization that exhibit surprisingly high viscosity index (VI) while, equally surprisingly, exhibit very low pour points. The compositions comprise $C_{30}$–$C_{1300}$ hydrocarbons, said compositions having a branch ratio of less than 0.19; weight average molecular weight between 300 and 45,000; number average molecular weight between 300 and 18,000; molecular weight distribution between 1 and 5 and pour point below −15° C.

Further, a novel composition has been discovered comprising 11-octyldocosane having the structure $$\begin{array}{c} H \\ CH_3(CH_2)_{10}C(CH_2)_9CH_3. \\ (CH_2)_7 \\ CH_3 \end{array}$$

The foregoing composition has been found to exhibit superior lubricant properties either alone or in a mixture with 9-methyl,11-octylheneicosane. Surprisingly, the mixture has a viscosity index of greater than 130 while maintaining a pour point less than −15° C. These compositions are representative of the instant invention comprising $C_{30}H_{62}$ alkanes having a branch ratio, or $CH_3/CH_2$ ratio, of less than 0.19. These low branch ratios and pour points characterize the compositions of the invention, referred to herein as polyalpha-olefin or HVI-PAO, conferring upon the compositions especially high viscosity indices in comparison to commercially available polyalpha-olefin (PAO) synthetic lubricants.

Unique lubricant oligomers of the instant invention can also be made in a wide range of molecular weights and viscosities comprising $C_{30}$ to $C_{1000}$ hydrocarbons having a branch ratio of less than 0.19 and molecular weight distribution of about 1.05 to 2.5. The oligomers can be mixed with conventional mineral oils or greases of other properties to provide compositions also possessing outstanding lubricant properties.

Compositions of the present invention can be prepared by the oligomerization of alpha-olefins such as 1-decene under oligomerization conditions in contact with a supported and reduced valence state metal oxide catalyst from Group VIB of the IUPAC Periodic Table. Chromium oxide is the preferred metal oxide.

DESCRIPTION OF THE FIGURES

FIG. 4 shows C-13 NMR spectra for HVI-PAO from 1-hexene.

FIG. 5 shows C-13 NMR spectra of 5 cs HVI-PAO from 1-decene.

FIG. 6 shows C-13 NMR spectra of 50 cs HVI-PAO from 1-decene.

FIG. 7 shows C-13 NMR spectra of 145 cs HVI-PAO from 1-decene.

DETAIL DESCRIPTION OF THE INVENTION

In the following description, unless otherwise stated, all references to HVI-PAO oligomers or lubricants refer to hydrogenated oligomers and lubricants in keeping with the practice well known to those skilled in the art of lubricant production. As oligomerized, HVI-PAO oligomers are mixtures of dialkyl vinyledenic and 1,2 dialkyl or trialkyl mono-olefins. Lower molecular weight unsaturated oligomers are preferably hydrogenated to produce thermally and oxidatively stable, useful lubricants. Higher molecular weight unsaturated HVI-PAO oligomers are sufficiently thermally stable to be utilized without hydrogenation and, optionally, may be so employed. Both unsaturated and hydrogenated HVI-PAO of lower or higher molecular exhibit viscosity indices of at least 130 and pour point below-15° C.

Figure 1:
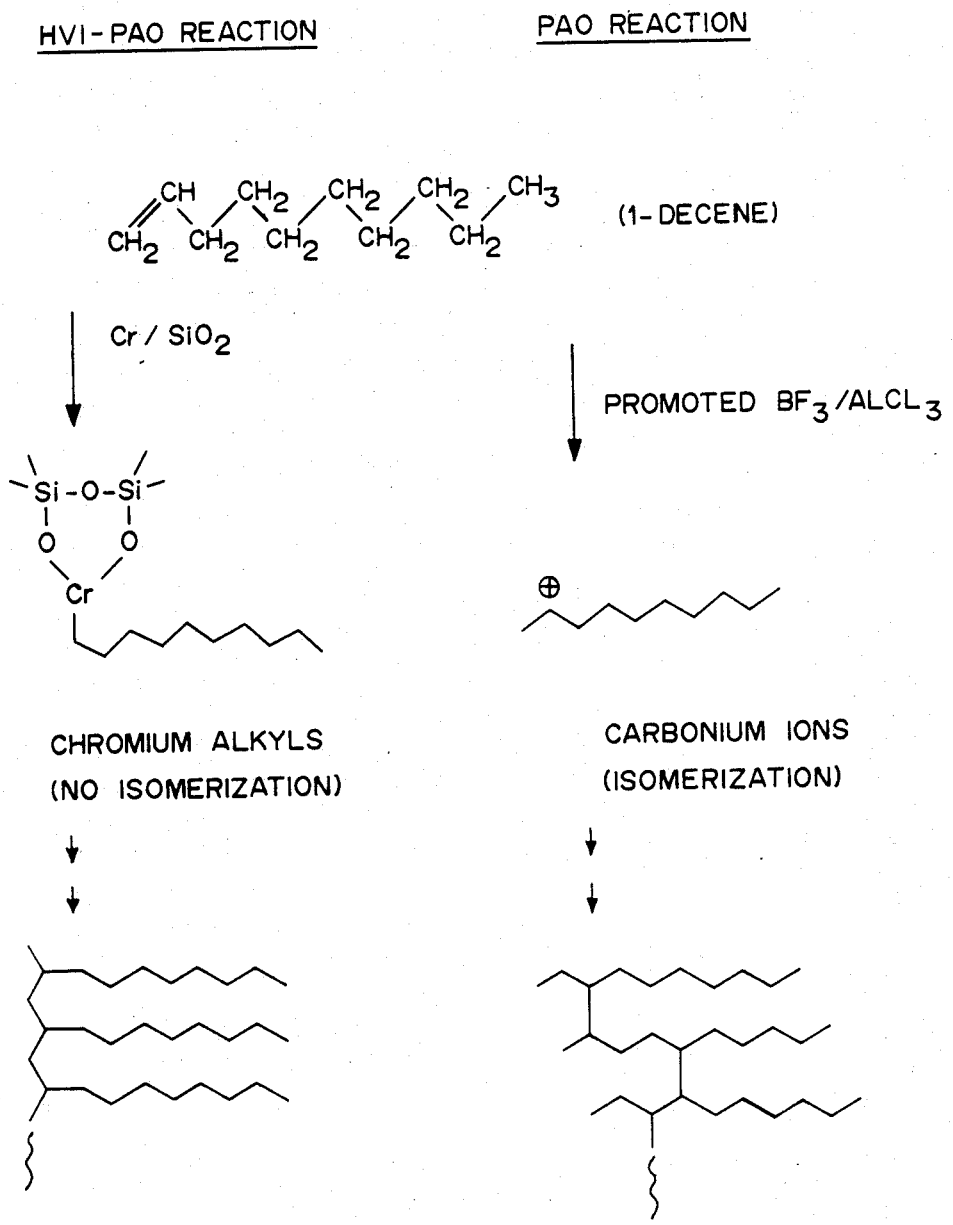
FIG. 1 is a comparison of PAO and HVI-PAO syntheses.

Referring to FIG. 1, the novel oligomers of the invention, or high viscosity index polyalphaolefins (HVI-PAO) are described in an illustration comparing them with conventional polyalphaolefins (PAO) from 1-decene. Polymerization with the novel reduced chromium catalyst described hereinafter leads to an oligomer substantially free of double bond isomerization. Conventional PAO, on the other hand, promoted by $BF_3$ or ALCl3 forms a carbonium ion which, in turn, promotes isomerization of the olefinic bond and the formation of multiple isomers. The HVI-PAO produced in the present invention has a structure with a $CH_3/CH_2$ ratio $<0.19$ compared to a ratio of $>0.20$ for PAO.

Figure 2:
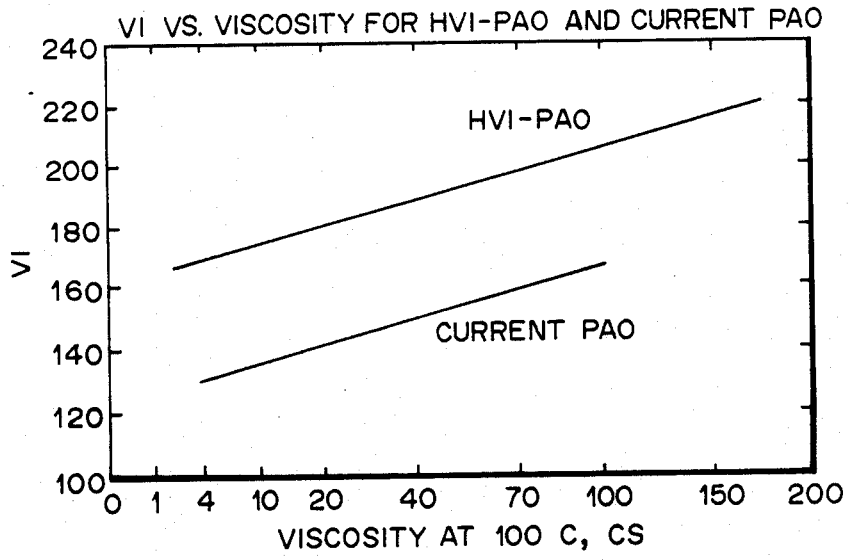
FIG. 2 compares VI for PAO and HVI-PAO.
Figure 3:
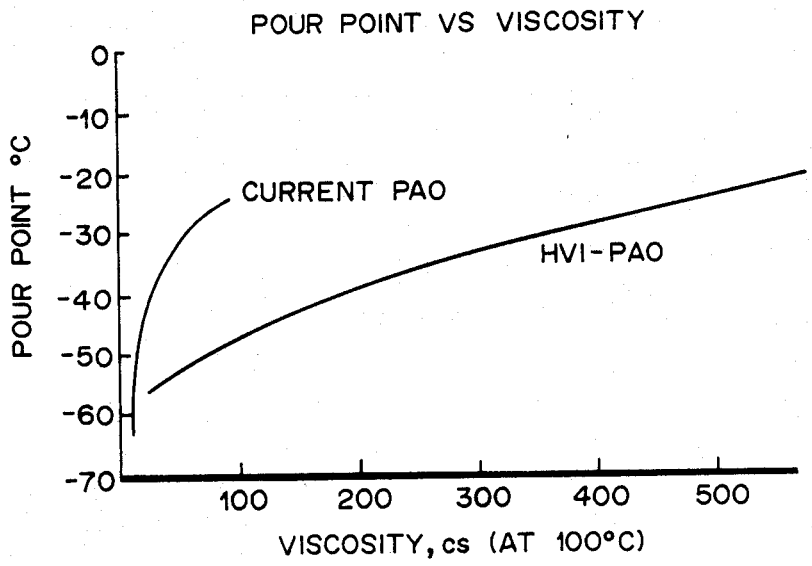
FIG. 3 shows pour points for PAO and HVI-PAO.

FIG. 2 compares the viscosity index versus viscosity relationship for HVI-PAO and PAO lubricants, showing that HVI-PAO is distinctly superior to PAO at all viscosities tested. Remarkably, despite the more regular structure of the HVI-PAO oligomers as shown by branch ratio that results in improved viscosity index (VI), they show pour points superior to PAO. Conceivably, oligomers of regular structure containing fewer isomers would be expected to have higher solidification temperatures and higher pour points, reducing their utility as lubricants. But, surprisingly, such is not the case for HVI-PAO of the present invention. FIGS. 2 and 3 illustrate superiority of HVI-PAO in terms of both pour point and VI.

It has been found that the process described herein to produce the novel HVI-PAO oligomers can be controlled to yield oligomers having weight average molecular weight between 300 and 45,000 and number average molecular weight between 300 and 18,000. Measured in carbon numbers, molecular weights range from $C_{30}$ to $C_{1300}$ and viscosity up to 750 cs at 100° C., with a preferred range of $C_{30}$ to $C_{1000}$ and a viscosity of up to 500 cs at 100° C. Molecular weight distributions (MWD), defined as the ratio of weight average molecular to number average molecular weight, range from 1.00 to 5, with a preferred range of 1.01 to 3 and a more preferred MWD of about 1.05 to 2.5. Compared to conventional PAO derived from $BF_3$ or $AlCl_3$ catalyzed polymerization of 1-alkene, HVI-PAO of the present invention has been found to have a higher proportion of higher molecular weight polymer molecules in the product.

Viscosities of the novel HVI-PAO oligomers measured at 100° C. range from 3 cs to 5000 cs. The viscosity index for the new polyalpha-olefins is approximately described by the following equation:

$$VI = 129.8 + 4.58 \times (V_{100}\ C)0.5,$$

where $V_{100}$° C. is kinematic viscosity in centistokes measured at 100° C.

The novel oligomer compositions disclosed herein have been examined to define their unique structure beyond the important characteristics of branch ratio and molecular weight already noted. Dimer and trimer fractions have been separated by distillation and components thereof further separated by gas chromatography. These lower oligomers and components along with complete reaction mixtures of HVI-PAO oligomers have been studied using infra-red spectroscopy and C-13 NMR. The studies have confirmed the highly uniform structural composition of the products of the invention, particularly when compared to conventional polyalphaolefins produced by $BF_3$, $AlCl_3$ or Ziegler-type catalysis. The unique capability of C-13 NMR to identify structural isomers has led to the identification of distinctive compounds in lower oligomeric fractions and served to confirm the more uniform isomeric mix present in higher molecular weight oligomers compatible with the finding of low branch ratios and superior viscosity indices.

1-hexene HVI-PAO oligomers of the present invention have been shown to have a very uniform linear $C_4$ branch and contain regular head-to-tail connections. In addition to the structures from the regular head-to-tail connections, the backbone structures have some head-to-head connection, indicative of the following structure as confirmed by NMR:

$$H(-\underset{\substack{(CH_2)_3\\ CH_3}}{CH}-CH_2-)_x-(-CH_2-\underset{\substack{(CH_2)_3\\ CH_3}}{CH}-)_yH$$

The NMR poly(1-hexene) spectra are shown in FIG. 4.

The oligomerization of 1-decene by reduced valence state, supported chromium also yields a HVI-PAO with a structure analogous to that of 1-hexene oligomer The lubricant products after distillation to remove light fractions and hydrogenation have characteristic C-13 NMR spectra. FIGS. 5, 6 and 7 are the C-13 NMR spectra of typical HVI-PAO lube products with viscosities of 5 cs, 50 cs and 145 cs at 100° C.

In the following tables, Table A presents the NMR data for FIG. 5, Table B presents the NMR data for FIG. 6 and Table C presents the NMR data for FIG. 7.

TABLE A

| | (FIG. 5) | | |
|---|---|---|---|
| Point | Shift (ppm) | Intensity | Width (Hz) |
| 1 | 79.096 | 138841. | 2.74 |
| 2 | 74.855 | 130653. | 4.52 |
| 3 | 42.394 | 148620. | 6.68 |
| 4 | 40.639 | 133441. | 37.6 |
| 5 | 40.298 | 163678. | 32.4 |
| 6 | 40.054 | 176339. | 31.2 |
| 7 | 39.420 | 134904. | 37.4 |
| 8 | 37.714 | 445452. | 7.38 |
| 9 | 37.373 | 227254. | 157 |
| 10 | 37.081 | 145467. | 186 |
| 11 | 36.788 | 153096. | 184 |
| 12 | 36.593 | 145681. | 186 |
| 13 | 36.447 | 132292. | 189 |
| 14 | 36.057 | 152778. | 184 |
| 15 | 35.619 | 206141. | 184 |
| 16 | 35.082 | 505413. | 26.8 |
| 17 | 34.351 | 741424. | 14.3 |
| 18 | 34.059 | 1265077. | 7.65 |

TABLE A-continued

| | (FIG. 5) | | |
|---|---|---|---|
| Point | Shift (ppm) | Intensity | Width (Hz) |
| 19 | 32.207 | 5351568. | 1.48 |
| 20 | 30.403 | 3563751. | 4.34 |
| 21 | 29.965 | 8294773. | 2.56 |
| 22 | 29.623 | 4714955. | 3.67 |
| 23 | 28.356 | 369728. | 10.4 |
| 24 | 28.161 | 305878. | 13.2 |
| 25 | 26.991 | 1481260. | 4.88 |
| 26 | 22.897 | 4548162. | 1.76 |
| 27 | 20.265 | 227694. | 1.99 |
| 28 | 14.221 | 4592991. | 1.62 |

TABLE B

| | (FIG. 6) | | |
|---|---|---|---|
| No. | Freq (Hz) | PPM | Int % |
| 1 | 1198.98 | 79.147 | 1056 |
| 2 | 1157.95 | 77.004 | 1040 |
| 3 | 1126.46 | 74.910 | 1025 |
| 4 | 559.57 | 37.211 | 491 |
| 5 | 526.61 | 35.019 | 805 |
| 6 | 514.89 | 34.240 | 1298 |
| 7 | 509.76 | 33.899 | 1140 |
| 8 | 491.45 | 32.681 | 897 |
| 9 | 482.66 | 32.097 | 9279 |
| 10 | 456.29 | 30.344 | 4972 |
| 11 | 448.24 | 29.808 | 9711 |
| 12 | 444.58 | 29.564 | 7463 |
| 13 | 426.26 | 28.347 | 1025 |
| 14 | 401.36 | 26.691 | 1690 |
| 15 | 342.77 | 22.794 | 9782 |
| 16 | 212.40 | 14.124 | 8634 |
| 17 | 0.00 | 0.000 | 315 |

TABLE C

| | (FIG. 7) | | |
|---|---|---|---|
| Point | Shift (ppm) | Intensity | Width (Hz) |
| 1 | 76.903 | 627426. | 2.92 |
| 2 | 40.811 | 901505. | 22.8 |
| 3 | 40.568 | 865686. | 23.1 |
| 4 | 40.324 | 823178. | 19.5 |
| 5 | 37.158 | 677621. | 183. |
| 6 | 36.915 | 705894. | 181. |
| 7 | 36.720 | 669037. | 183. |
| 8 | 36.428 | 691870. | 183. |
| 9 | 36.233 | 696323. | 181. |
| 10 | 35.259 | 1315574. | 155. |
| 11 | 35.015 | 1471226. | 152. |
| 12 | 34.333 | 1901096. | 121. |
| 13 | 32.726 | 1990364. | 120. |
| 14 | 32.141 | 20319110. | 2.81 |
| 15 | 31.362 | 1661594. | 148. |
| 16 | 30.388 | 9516199. | 19.6 |
| 17 | 29.901 | 17778892. | 9.64 |
| 18 | 29.609 | 18706236. | 9.17 |
| 19 | 28.391 | 1869681. | 122. |
| 20 | 27.514 | 1117864. | 173. |
| 21 | 26.735 | 2954012. | 14.0 |
| 22 | 22.839 | 20895526. | 2.17 |
| 23 | 14.169 | 16670130. | 2.06 |

In general, the novel oligomers have the following regular head-to-tail structure where n can be 3 to 17:

$$-(\underset{\substack{(CH_2)_n\\ CH_3}}{CH}-CH_2)_x-$$

with some head-to-head connections.

The trimer of 1-decene HVI-PAO oligomer is separated from the oligomerization mixture by distillation from a 20 cs as-synthesized HVI-PAO in a short-path apparatus in the range of 165°-210° C. at 0.1-0.2 torr. The unhydrogenated trimer exhibited the following viscometric properties:

V@40 C.=14.88 cs; V@100° C.=3.67 cs; VI=137

The trimer is hydrogenated at 235° C. and 4200 kPa $H_2$ with Ni on kieselguhr hydrogenation catalyst to give a hydrogenated HVI-PAO trimer with the following properties:

V@40° C.=16.66 cs; V@100° C.=3.91 cs; VI=133

Pour Point=less than −45° C.;

Gas chromatographic analysis of the trimer reveals that it is composed of essentially two components having retention times of 1810 seconds and 1878 seconds under the following conditions:

G. C. column-60 meter capillary column, 0.32 mmid, coated with stationary phase SPB-1 with film thickness 0.25 μm, available from Supelco chromatography supplies, catalog no. 2-4046.

Separation Conditions—Varian Gas chromatograph, model no. 3700, equipped with a flame ionization detector and capillary injector port with split ratio of about 50. $N_2$ carrier gas flow rate is 2.5 cc/minute. Injector port temperature 300° C.; detector port temperature 330° C., column temperature is set initially at 45° C. for 6 minutes, programmed heating at 15° C./minute to 300° C. final temperature and holding at final temperature for 60 minutes. Sample injection size is 1 microliter. Under these conditions, the retention time of a g.c. standard, n-dodecane, is 968 seconds.

Figure 8:
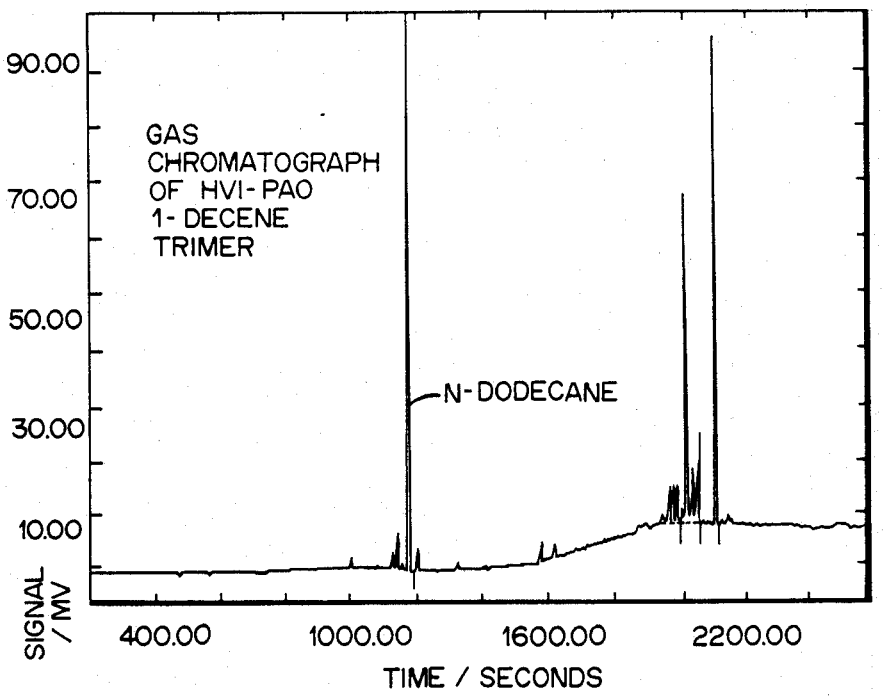
FIG. 8 shows the gas chromatograph of HVI-PAO 1-decene trimer.

A typical chromatograph is shown in FIG. 8.

The C-13 NMR spectra, (FIG. 9), of the distilled C30 product confirm the chemical structures. Table D lists C-13 NMR data for FIG. 9.

TABLE D

| | (FIG. (9) | | |
|---|---|---|---|
| Point | Shift (ppm) | Intensity | Width (Hz) |
| 1 | 55.987 | 11080. | 2.30 |
| 2 | 42.632 | 13367. | 140. |
| 3 | 42.388 | 16612. | 263. |
| 4 | 37.807 | 40273. | 5.90 |
| 5 | 37.319 | 12257. | 16.2 |
| 6 | 36.539 | 11374. | 12.1 |
| 7 | 35.418 | 11631. | 35.3 |
| 8 | 35.126 | 33099. | 3.14 |
| 9 | 34.638 | 39277. | 14.6 |
| 10 | 34.054 | 110899. | 3.32 |
| 11 | 33.615 | 12544. | 34.9 |
| 12 | 33.469 | 13698. | 34.2 |
| 13 | 32.981 | 11278. | 5.69 |
| 14 | 32.835 | 13785. | 57.4 |
| 15 | 32.201 | 256181. | 1.41 |
| 16 | 31.811 | 17867. | 24.6 |
| 17 | 31.470 | 13327. | 57.4 |
| 18 | 30.398 | 261859. | 3.36 |
| 19 | 29.959 | 543993. | 1.89 |
| 20 | 29.618 | 317314. | 1.19 |
| 21 | 28.838 | 11325. | 15.1 |
| 22 | 28.351 | 24926. | 12.4 |
| 23 | 28.156 | 29663. | 6.17 |
| 24 | 27.230 | 44024. | 11.7 |
| 25 | 26.986 | 125437. | −0.261 |
| 26 | 22.892 | 271278. | 1.15 |
| 27 | 20.260 | 17578. | −22.1 |
| 28 | 14.167 | 201979. | 2.01 |

Figure 9:
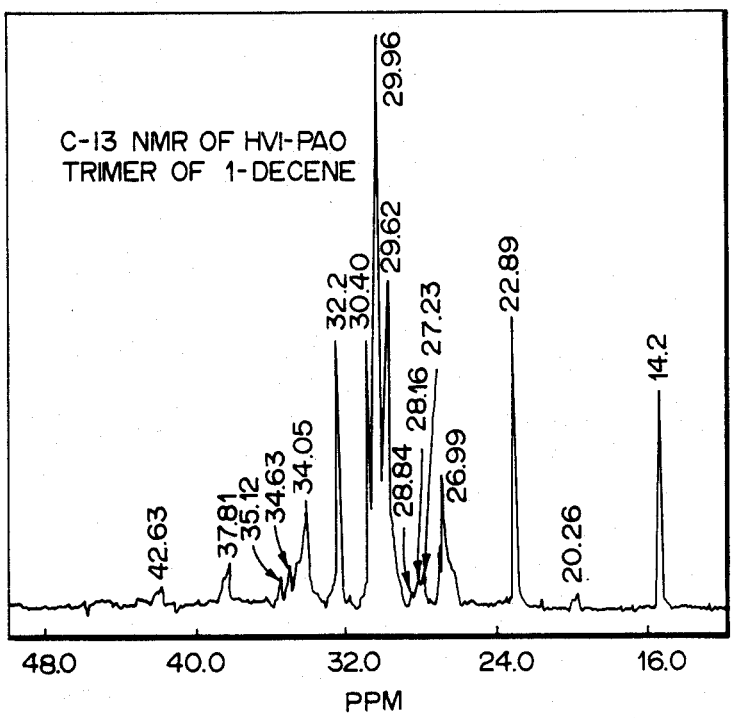
FIG. 9 shows C-13 NMR of HVI-PAO trimer of 1-decene.
Figure 10:
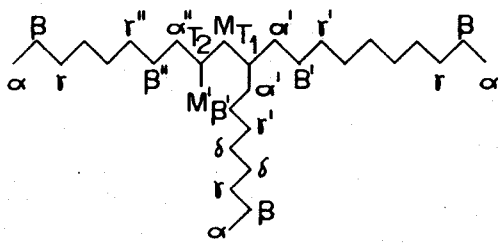
FIG. 10 shows C-13 NMR calculated vs. observed chemical shifts for HVI-PAO 1-decene trimer components.
Figure 10:
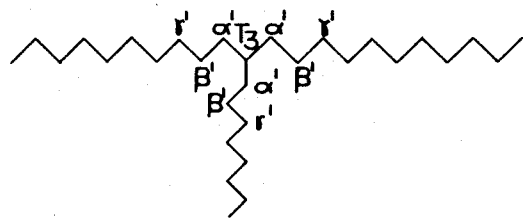

The individual peak assignment of the C-13 spectra are shown in FIG. 9. Based on these structures, the calculated chemical shifts, as shown in FIG. 10, matched closely with the observed chemical shifts. The calculation of chemical shifts of hydrocarbons is carried out as described is "Carbon-13 NMR for Organic Chemists" by G. C. Levy and G. L. Nelson, 1972, by John Wiley & Sons, Inc., Chapter 3, p 38-41. The components were identified as 9-methyl,11-octylheneicosane and 11-octyldocosane by infrared and C-13 NMR analysis and were found to be present in a ratio between 1:10 and 10:1 heneicosane to docosane. The hydrogenated 1-decene trimer produced by the process of this invention has an index of refraction at 60° C. of 1.4396.

The process of the present invention produces a surprisingly simpler and useful dimer compared to the dimer produced by 1-alkene oligomerization with $BF_3$ or $AlCl_3$ as commercially practiced. Typically, in the present invention it has been found that a significant proportion of unhydrogenated dimerized 1-alkene has a vinylidenyl structure as follows:

$CH_2{=}CR_1R_2$ where $R_1$ and $R_2$ are alkyl groups representing the residue from the head-to-tail addition of 1-alkene molecules. For example, 1-decene dimer of the invention has been found to contain only three major components, as determined by GC. Based on $C^{13}$ NMR analysis, the unhydrogenated components were found to be 8-eicosene, 9-eicosene, 2-octyldodecene and 9-methyl-8 or 9-methyl-9-nonadecene. The hydrogenated dimer components were found to be n-eicosane and 9-methylnonacosane.

Olefins suitable for use as starting material in the invention include those olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-heptene to 1-hexadecene and more preferably 1-octene to 1-tetradecene, or mixtures of such olefins.

Oligomers of alpha-olefins in accordance with the invention have a low branch ratio of less than 0.19 and superior lubricating properties compared to the alpha-olefin oligomers with a high branch ratio, as produced in all known commercial methods.

This new class of alpha-olefin oligomers are prepared by oligomerization reactions in which a major proportion of the double bonds of the alphaolefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds.

Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the lube oil are calculated from the weight fractions of methyl groups obtained by infrared methods, published in *Analytical Chemistry,* Vol. 25, No. 10, p. 1466 (1953).

$$\text{Branch ratio} = \frac{\text{wt fraction of methyl group}}{1 - (\text{wt fraction of methyl group})}$$

As referenced hereinbefore, supported Cr metal oxide in different oxidation states is known to polymerize alpha olefins from $C_3$ to $C_{20}$ (De 3427319 to H. L. Krauss and Journal of Catalysis 88, 424–430, 1984) using a catalyst prepared by $CrO_3$ on silica. The referenced disclosures teach that polymerization takes place at low temperature, usually less than 100° C., to give adhesive polymers and that at high temperature, the catalyst promotes isomerization, cracking and hydrogen transfer reactions. The present inventions produce low molecular weight oligomeric products under reaction conditions and using catalysts which minimize side reactions such as 1-olefin isomerization, cracking, hydrogen transfer and aromatization. To produce the novel low molecular weight products suitable for use as lube basestock or as blending stock with other lube stock, the reaction of the present invention is carried out at a temperature higher (90°–250° C.) than the temperature suitable to produce high molecular weight polyalphaolefins. The catalysts used in the present invention do not cause a significant amount of side reactions even at high temperature when oligomeric, low molecular weight fluids are produced.

The catalysts for this invention thus minimize all side reactions but oligomerize alpha olefins to give low molecular weight polymers with high efficiency. It is well known in the prior art that chromium oxides, especially chromia with average +3 oxidation states, either pure or supported, catalyze double bond isomerization, dehydrogenation, cracking, etc. Although the exact nature of the supported Cr oxide is difficult to determine, it is thought that the catalyst of the present invention is rich in Cr(II) supported on silica, which is more active to catalyze alphaolefin oligomerization at high reaction temperature without causing significant amounts of isomerization, cracking or hydrogenation reactions, etc. However, catalysts as prepared in the cited references can be richer in Cr (III). They catalyze alpha-olefin polymerization at low reaction temperature to produce high molecular weight polymers. However, as the references teach, undesirable isomerization, cracking and hydrogenation reaction takes place at higher temperatures. In contrast, high temperatures are needed in this invention to produce lubricant products. The prior art also teaches that supported Cr catalysts rich in Cr(III) or higher oxidation states catalyze 1-butene isomerization with $10^3$ higher activity than polymerization of 1-butene. The quality of the catalyst, method of preparation, treatments and reaction conditions are critical to the catalyst performance and composition of the product produced and distinguish the present invention over the prior art.

In the instant invention very low catalyst concentrations based on feed, from 10 wt % to 0.01 wt %, are used to produce oligomers; whereas, in the cited references catalyst ratios based on feed of 1:1 are used to prepare high polymer. Resorting to lower catalyst concentrations in the present invention to produce lower molecular weight material runs counter to conventional polymerization theory, compared to the results in the cited references.

The oligomers of 1-olefins prepared in this invention usually have much lower molecular weights than the polymers produced in cited reference which are semi-solids, with very high molecular weights. They are not suitable as lubricant basestocks. These high polymers usually have no detectable amount of dimer or trimmer ($C_{10}$–$C_{30}$) components from synthesis. These high polymers also have very low unsaturations. However, products in this invention are free-flowing liquids at room temperature, suitable for lube basestock, containing significant amount of dimer or trimer and have high unsaturations.

The following examples of the instant invention are presented merely for illustration purposes and are not intended to limit the scope of the present invention.

EXAMPLE 1

Catalyst Preparation and Activation Procedure 1.9 grams of chromium (II) acetate ($Cr_2(OCOCH_3)_4 2H_2O$)(5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g) is packed in a ⅜" stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 3

Similar to Example 2, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosities, cS at | | |
| 40° C. | 13170 | 19011 |
| 100° C. | 620 | 1048 |
| VI | 217 | 263 |

EXAMPLE 4

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 5

As in Example 4, purified 1-decene is pumped through the reactor at 250 to 320 psi. The product is collected periodically and stripped of light products boiling points below 650° F. High quality lubes with high VI are obtained (see following table).

| Reaction Temp. °C. | WHSV g/g/hr | Lube Product Properties V at 40° C. | V at 100° C. | VI |
|---|---|---|---|---|
| 120 | 2.5 | 1555.4 cs | 157.6 cs | 217 |
| 135 | 0.6 | 389.4 | 53.0 | 202 |
| 150 | 1.2 | 266.8 | 36.2 | 185 |
| 166 | 0.6 | 67.7 | 12.3 | 181 |
| 197 | 0.5 | 21.6 | 5.1 | 172 |

EXAMPLE 6

Similar catalyst is used in testing 1-hexene oligomerization at different temperature. 1-Hexene is fed at 28 cc/hr and at 1 atmosphere.

| Sample | G | H |
|---|---|---|
| Temperature, °C. | 110 | 200 |
| Lube Yield, wt. % | 46 | 3 |
| Viscosities, cS at | | |
| 40° C. | 3512 | 3760 |
| 100° C. | 206 | 47 |
| VI | 174 | 185 |

EXAMPLE 7

1.5 grams of a similar catalyst as prepared in Example 4 was added to a two-neck flask under $N_2$ atmosphere. Then 25 g of 1-hexene was added. The slurry was heated to 55° C. under $N_2$ atmosphere for 2 hours. Then some heptane solvent was added and the catalyst was removed by filtration. The solvent and unreacted starting material was stripped off to give a viscous liquid with a 61% yield. This viscous liquid had viscosities of 1536 and 51821 cs at 100° C. and 40° C., respectively. This example demonstrated that the reaction can be carried out in a batch operation.

The 1-decene oligomers as described below were synthesized by reacting purified 1-decene with an activated chromium on silica catalyst. The activated catalyst was prepared by calcining chromium acetate (1 or 3% Cr) on silica gel at 500°–800° C. for 16 hours, followed by treating the catalyst with CO at 300°-350° C. for 1 hour. 1-Decene was mixed with the activated catalyst and heated to reaction temperature for 16-21 hours. The catalyst was then removed and the viscous product was distilled to remove low boiling components at 200° C./0.1 mmHg.

Reaction conditions and results for the lube synthesis of HVI-PAO are summarized below:

TABLE 1

| Example NO. | Cr on Silica | Calcination Temp. | Treatment Temp. | 1-decene/ Catalyst Ratio | Lube Yld |
|---|---|---|---|---|---|
| 8 | 3 wt % | 700° C. | 350° C. | 40 | 90 |
| 9 | 3 | 700 | 350 | 40 | 90 |
| 10 | 1 | 500 | 350 | 45 | 86 |
| 11 | 1 | 600 | 350 | 16 | 92 |

TABLE 2

Branch Ratios and Lube Properties of Examples 8-11 Alpha Olefin Oligomers

| Example No. | Branch $\underline{CH_3}$ Ratios $CH_2$ | V 40° C. | V 100° C. | VI |
|---|---|---|---|---|
| 8 | 0.14 | 150.5 | 22.8 | 181 |
| 9 | 0.15 | 301.4 | 40.1 | 186 |
| 10 | 0.16 | 1205.9 | 128.3 | 212 |
| 11 | 0.15 | 5238.0 | 483.1 | 271 |

TABLE 3

Branch Ratios and Lubricating Properties of Alpha Olefin Oligomers Prepared in the Prior-Art

| Example No. | Branch $\underline{CH_3}$ Ratios $CH_2$ | V 40° C. | V 100° C. | VI |
|---|---|---|---|---|
| 12 | 0.24 | 28.9 | 5.21 | 136 |
| 13 | 0.19 | 424.6 | 41.5 | 148 |
| 14 | — 0.19 | 1250 | 100 | 168 |
| 15 | 0.19 | 1247.4 | 98.8 | 166 |

These samples are obtained from the commercial market. They have higher branch ratios than samples in Table 2. Also, they have lower VI's than the previous samples.

Comparison of these two sets of lubricants clearly demonstrates that oligomers of alpha-olefins, as 1-decene, with branch ratios lower than 0.19, preferably from 0.13 to 0.18, have higher VI and are better lubricants. The examples prepared in accordance with this invention have branch ratios of 0.14 to 0.16, providing lube oils of excellent quality which have a wide range of viscosities from 3 to 483.1 cs at 100° C. with viscosity indices of 130 to 280.

EXAMPLE 16

A commercial Cr on silica catalyst which contains 1% Cr on a large pore volume synthetic silica gel is used. The catalyst is first calcined with air at 700° C. for 16 hours and reduced with CO at 350° C. for one to two hours. 1.0 part by weight of the activated catalyst is added to 1-decene of 200 parts by weight in a suitable reactor and heated to 185° C. 1-Decene is continuously fed to the reactor at 2-3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150° C.@0.1 mm Hg is stripped. The residual product is hydrogenated with a Ni on Kieselguhr catalyst at 200° C. The finished product has a viscosity at 100° C. of 18.5 cs, VI of 165 and pour point of −55° C.

EXAMPLE 17

Similar as in Example 16, except reaction temperature is 125° C. The finished product has a viscosity at 100° C. of 145 cs, VI of 214, pour point of −40° C.

Example 18

Similar as in Example 16, except reaction temperature is 100° C. The finished product has a viscosity at 100° C. of 298 cs, VI of 246 and pour point of −32° C.

The final lube products in Example 16 to 18 contain the following amounts of dimer and trimer and isomeric distribution (distr.).

| Example | 16 | 17 | 18 |
|---|---|---|---|
| Vcs @ 100° C. | 18.5 | 145 | 298 |
| VI | 165 | 214 | 246 |
| Pour Point, °C. | −55° C. | −40° C. | −32 |
| wt % dimer | 0.01 | 0.01 | 0.027 |
| wt % isomeric distr. dimer | | | |
| n-eicosane | 51% | 28% | 73% |
| 9-methylnonacosane | 49% | 72% | 27% |
| wt % trimer | 5.53 | 0.79 | 0.27 |
| wt % isomeric distr. trimer | | | |
| 11-octyldocosane | 55 | 48 | 44 |
| 9-methyl,11-octyl-heneicosane | 35 | 49 | 40 |
| others | 10 | 13 | 16 |

These three examples demonstrate that the new HVI-PAO of wide viscosities contain the dimer and trimer of unique structures in various proportions.

The molecular weights and molecular weight distributions are analyzed by a high pressure liquid chromatography, composed of a Constametric II high pressure, dual piston pump from Milton Roy Co. and a Tracor 945 LC detector. During analysis, the system pressure is 650 psi and THF solvent (HPLC grade) deliver rate is cc per minute. The detector block temperature is set at 145° C. cc of sample, prepared by dissolving 1 gram PAO sample in cc THF solvent, is injected into the chromatograph. The sample is eluted over the following columns in series, all from Waters Associates: Utrastyragel $10^5$ A, P/N 10574, Utrastyragel $10^4$ A, P/N 10573, Utrastyragel $10^3$ A, P/N 10572, Utrastyragel 500 A, P/N 10571. The molecular weights are calibrated against commercially available PAO from Mobil Chemical Co, Mobil SHF-61 and SHF-81 and SHF-401.

The following table summarizes the molecular weights and distributions of Examples 16 to 18.

| Examples | 16 | 17 | 18 |
|---|---|---|---|
| V @ 100° C., cs | 18.5 | 145 | 298 |
| VI | 165 | 214 | 246 |
| number-averaged molecular weights, $MW_n$ | 1670 | 2062 | 5990 |
| weight-averaged molecular weights, $MW_w$ | 2420 | 4411 | 13290 |
| molecular weight distribution, MWD | 1.45 | 2.14 | 2.22 |

Under similar conditions, HVI-PAO product with viscosity as low as 3 cs and as high as 500 cs, with VI between 130 and 280, can be produced.

The use of supported Group VIB oxides as a catalyst to oligomerize olefins to produce low branch ratio lube products with low pour points was heretofore unknown. The catalytic production of oligomers with structures having a low branch ratio which does not use a corrosive co-catalyst and produces a lube with a wide range of viscosities and good V.I.'s was also heretofore unknown and more specifically the preparation of lube oils having a branch ratio of less than about 0.19 was also unknown heretofore.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A liquid lubricant composition comprising $C_{30}$–$C_{1300}$ hydrocarbons, said composition having a branch ratio of less than 0.19, weight average molecular weight between 300 and 45,000, number average molecular weight between 300 and 18,000, molecular weight distribution between 1 and 5 and pour point below −15° C.

2. The composition or claim 1 wherein said hydrocarbons comprise $C_{30}$–$C_{1000}$ hydrocarbons and molecular weight distribution of about 2.5

3. The composition of claim 1 wherein said hydrocarbons comprise alkanes.

4. The composition of claim 1 wherein said hydrocarbons comprise alkenes.

5. The composition of claim 1 having a viscosity index greater than 130 and viscosity at 100° C. between 3 cs and 750 cs.

6. The composition of claim 1 having a $C_{30}$ fraction with a branch ratio below 0.19, viscosity index greater than 130 and pour point below −45° C.

7. A liquid lubricant hydrocarbon composition comprising the polymeric residue of 1-alkenes taken from the group consisting essentially of linear $C_6$–$C_{20}$ 1-alkenes, said composition having a branch ratio of less than 0.19, weight average molecular weight between 300 and 45,000, number average molecular weight between 300 and 18,000, molecular weight distribution between 1 and 5 and pour point below −15° C.

8. The composition of claim 7 wherein said 1-alkenes comprise preferably $C_8$–$C_{12}$ alkenes.

9. The composltion of claim 7 wherein said polymeric residue comprises hydrogenated polymeric residue of said 1-alkenes.

10. The composition of claim 7 or 9 wherein said polymeric residue comprises poly 1-decene.

11. The composition of claim 10 comprising the polymeric residue of 1-decene having a molecular weight of about 422.

12. The composition of claim 11 having a viscosity index of about 134 and a pour point less than −45° C.

13. The composition of claim 7 or 9 having a viscosity index between 130 and 280.

14. A liquid lubricant hydrocarbon composition having the recurring polymeric structure $$[-CH_2-\underset{\substack{(CH_2)_m\\ CH_3}}{CH}-]_n$$

where m is 3 to 12 and n is 5 to 500.

15. The composition of claim 14 where m is seven and average n is fifteen.

16. The composition of claim 14 having a viscosity index greater than 130 and a pour point less than −15° C.

17. A hydrocarbon composition useful as a lubricant comprising a mixture of $C_{30}$ alkanes consisting essentially of 9-methyl,11-octylheneicosane and 11-octyldocosane.

18. The composition of claim 17 wherein the mole ratio of 9-methyl,11-octylheneicosane to 11-octyldocosane is between about 1:10 and 10:1.

19. The composition of claim 18 wherein said mole ratio is preferably about 1:2 to 2:1.

20. A hydrocarbon composition useful as a lubricant comprising $C_{30}H_{62}$ alkanes having a branch ratio less than 0.19 and pour point below −15° C.

21. The composition of claim 20 wherein said alkanes have a viscosity between 3 cs and 4 cs at 100° C., viscosity index greater than 130 and pour point below −45° C.

22. A composition of matter comprising 11-octyldocosane having the structure, $$CH_3(CH_2)_{10}\overset{\substack{H\\ (CH_2)_7\\ CH_3}}{C}(CH_2)_9CH_3.$$

23. A lubricant composition comprising 11-octyldocosane.

24. A liquid lubricant composition comprising the product of the oligomerization of $C_6$ to $C_{20}$ alpha-olefin feedstock, or mixtures thereof, under oligomerization conditions in contact with a reduced valence state Group VIB metal catalyst on porous support, said lubricant having a branch ratio less than 0.19, viscosity index greater than 130 and a pour point less than −15° C.

25. The composition of claim 24 wherein said oligomerization conditions comprise temperature between 90− 250° C. and feedstock to catalyst weight ratio between 10:1 and 30:1; said catalyst comprises CO reduced $CrO_3$ and said support comprises silica having a pore size of at least 40 Angstroms.

26. The composition of claim 24 wherein said alpha-olefin is selected from 1-octene, 1-decene, 1-dodecene, and mixtures thereof.

27. The composition of claim 24 wherein said olefin is 1-decene.

* * * * *